US009340988B2

(12) United States Patent
Lyristakis

(10) Patent No.: US 9,340,988 B2
(45) Date of Patent: May 17, 2016

(54) POOL OR SPA DRAIN COVER

(71) Applicant: Mick George Lyristakis, Bonita Springs, FL (US)

(72) Inventor: Mick George Lyristakis, Bonita Springs, FL (US)

( * ) Notice: Subject to any disclaimer, the term of this patent is extended or adjusted under 35 U.S.C. 154(b) by 649 days.

(21) Appl. No.: 13/716,121

(22) Filed: Dec. 15, 2012

(65) Prior Publication Data

US 2013/0152298 A1 Jun. 20, 2013

Related U.S. Application Data

(60) Provisional application No. 61/576,581, filed on Dec. 16, 2011.

(51) Int. Cl.
*E04H 4/06* (2006.01)
*E04H 4/12* (2006.01)

(52) U.S. Cl.
CPC ..... *E04H 4/06* (2013.01); *E04H 4/1236* (2013.01)

(58) Field of Classification Search
CPC ..... B65D 45/28; E03F 2005/063; E03F 2005/065; E03F 5/0407; E04H 4/1236; E04H 4/1245; E04H 4/1254; E04H 4/1272; F16J 13/04
USPC ..... 4/218, 286–288, 293, 504, 506–508, 4/510, 679–680; 49/465; 52/602.1; 210/162–164; 220/323, 325, 328; 404/25
See application file for complete search history.

(56) References Cited

U.S. PATENT DOCUMENTS

| | | | | | |
|---|---|---|---|---|---|
| 2,896,223 | A * | 7/1959 | Treslo | 4/286 | |
| 4,170,047 | A * | 10/1979 | Corsette et al. | 4/293 | |
| 4,257,892 | A * | 3/1981 | Boersma | 210/163 | |
| 4,460,462 | A * | 7/1984 | Arneson | 210/163 | |
| 4,902,165 | A * | 2/1990 | Embree | 404/25 | |
| 5,148,938 | A * | 9/1992 | Morgan, Jr. | 220/316 | |
| 6,165,357 | A * | 12/2000 | Cormier | E04D 13/0409 | 210/163 |
| 6,330,724 | B1 * | 12/2001 | Belle | 4/288 | |
| 6,360,379 | B1 * | 3/2002 | Lane et al. | 4/507 | |
| 6,584,734 | B2 * | 7/2003 | Mihalicz et al. | 52/19 | |
| 6,592,756 | B1 * | 7/2003 | Felix et al. | 210/167.12 | |
| 6,817,043 | B2 * | 11/2004 | Zars | 4/504 | |
| 7,704,010 | B2 * | 4/2010 | Nolle | E02D 29/14 | 404/25 |

* cited by examiner

*Primary Examiner* — Paul R Durand
*Assistant Examiner* — Nicholas Ros
(74) *Attorney, Agent, or Firm* — John C. Pokotylo; Straub & Pokotylo

(57) ABSTRACT

A pool drain cover includes a center hub which can be rotated with respect to an outer portion. A twisting of the center hub causes multiple (e.g., three or more) engagement arm assemblies to extend such that their distal ends engage the inner surface of a pool drain pipe, thereby holding the pool drain cover in place. The distal ends of the engagement arms may be provided with an anti-slip coating such as, for example, vinyl, rubber, etc., and/or an anti-slip finish. Alternatively, a metal (e.g., stainless steel) tab extending from the distal end of each of the engagement arm assemblies can be provided. The engagement arm assemblies can be released by twisting the center hub in the opposite direction, thereby permitting the pool drain cover to be removed.

18 Claims, 16 Drawing Sheets

ENGAGEMENT ARM 120

800

POOL OR SPA DRAIN COVER

§0. RELATED APPLICATIONS

This application claims the benefit of U.S. Provisional Patent Application Ser. No. 61/576,581 (incorporated herein by reference and referred to as "the '581 provisional"), filed on Dec. 16, 2011, titled "POOL DRAIN COVER" and listing Mick George LYRISTAKIS as the inventor. The present invention is not limited to requirements of the particular embodiments described in the '581 provisional application.

§1. BACKGROUND OF THE INVENTION

Conventional pool and spa drain covers (generally referred to as "pool drain covers" without loss of generality) are typically made from poly-vinyl chloride ("PVC") as one piece. Such conventional pool drain covers are typically installed with screws, the screws being screwed into holes either provided in a drain pipe fitting, or in a bottom surface of the pool. Unfortunately, the present inventor believes that such conventional pool drain covers have a number of inherent problems. These problems are discussed below.

First, since conventional pool drain covers are held by screws which are screwed into a drain pipe fitting or the bottom surface of a pool, a potentially significant safety problem exists since a swimmer's hair, swim gear, jewelry, etc., may become entrapped in or by the pool drain cover. Even modern double drain safety systems to prevent high suction from holding a swimmer cannot totally prevent the potential for entrapment in or by the pool drain cover.

Second, since pool drain pipes might be different sizes, or have fittings with screw holes in different areas, and since bottom surfaces may have screw holes at different positions and/or spaced at different distances, it may be necessary to maintain an inventory of different pool drain cover sizes and/or configurations. Furthermore, holes in a drain pipe fitting or the pool bottom surface may compromise the watertight integrity of the pool, leading to leaks. Moreover, using screws to hold the cover in place requires multiple twists of multiple screws during installation or removal.

In view of the foregoing problems, it would be useful to provide an improved pool drain cover that overcomes one or more of the foregoing problems associated with conventional pool drain covers.

§2. SUMMARY OF THE INVENTION

An improved pool drain cover consistent with the present invention provides a center hub which can be rotated with respect to an outer portion. A twisting of the center hub causes multiple (e.g., three or more) engagement arm assemblies to extend such that their distal ends engage the inner surface of a pool drain pipe, thereby holding the improved pool drain cover in place. The distal ends of the engagement arms may be provided with an anti-slip coating such as, for example, vinyl, rubber, etc., and/or an anti-slip finish. In one example embodiment, a metal (e.g., stainless steel) tab extending from the distal end of each of the engagement arm assemblies is provided. The engagement arm assemblies can be released by twisting the center hub in the opposite direction, thereby permitting the pool drain cover to be removed.

Example pool drain covers consistent with the present invention may provide one or more of the following advantages:

It is an anti-entrapment device because it is only held in the pool drain by tension along the sides of the drain. This tension is sufficient to hold the drain cover to the drain when the pool is vacuumed, yet may permit the drain cover to be released from the drain by sufficient force in case of emergency.

It is easy to install with one twist of the center hub which causes two, or three (or more) engagement arm assemblies, preferably provided with anti slip substance or a metal tab at their distal ends, to engage the inside surface of the pool drain.

It prevents leaks in the area around the pool drain because no holes need to be made in the bottom finish of the pool to attach the drain cover.

It fits drains having different sizes and/or different configurations. Different models of the pool drain cover may be used to cover different size ranges of drain pipe. For example, the most common pool drain cover found in residential pools is called "8 inch," but depending on the manufacturer, the size varies and screw hole positions vary. Example embodiments consistent with the present invention can fit a drain pipe having an inner diameter from approximately 6.3" to 7.6" to account for these variations. Additional models consistent with the present invention may cover ranges due to variations in the inner diameters of "6 inch" and "10 inch" drain pipes, or other diameter drain pipes.

§3. BRIEF DESCRIPTION OF THE DRAWINGS

§4. DETAILED DESCRIPTION

The present invention may involve novel methods and/or apparatus for covering a pool drain. The following description is presented to enable one skilled in the art to make and use the invention, and is provided in the context of particular applications and their requirements. Thus, the following description of embodiments consistent with the present invention provides illustration and description, but is not intended to be exhaustive or to limit the present invention to the precise form disclosed. Various modifications to the disclosed embodiments will be apparent to those skilled in the art, and the general principles set forth below may be applied to other embodiments and applications. For example, although a series of acts may be described with reference to a flow diagram, the order of acts may differ in other implementations when the performance of one act is not dependent on the completion of another act. Further, non-dependent acts may be performed in parallel. No element, act or instruction used in the description should be construed as critical or essential to the present invention unless explicitly described as such. Also, as used herein, the article "a" is intended to include one or more items. Where only one item is intended, the term "one" or similar language is used. Thus, the present invention is not intended to be limited to the embodiments shown and the inventor regards his invention as any patentable subject matter described.

An example pool drain cover consistent with the present invention covers a pool drain and doesn't need to be held in place with screws going into the drain pipe or the surface of the pool bottom. Yet, such an example cover is held firmly in place to withstand manual or automatic pool vacuuming.

An example pool drain cover consistent with the present invention may have anti-entrapment properties. For example, it can be pulled out from the drain pipe if anything were to become stuck in it (such as hair, jewelry, or clothing of a swimmer), thereby enabling a swimmer to free themselves from the drain.

An example pool drain cover consistent with the present invention is easy to install with a simple twist of the center hub (e.g., by hand, or with a tool, such as a half inch wrench, a rod coupled with a universal hub adaptor, etc., that will engage with different perpendicular, or substantially perpendicular walls of an engagement hole in its center). The example pool drain cover may prevent leaks in the pool because, unlike conventional pool drain covers, no holes are needed in the bottom of the pool at or around the drain to secure the cover in place. The example pool drain cover can fit multiple size pool drains (e.g., due to variations in the inner diameter of pool drain pipe).

Figure 1:
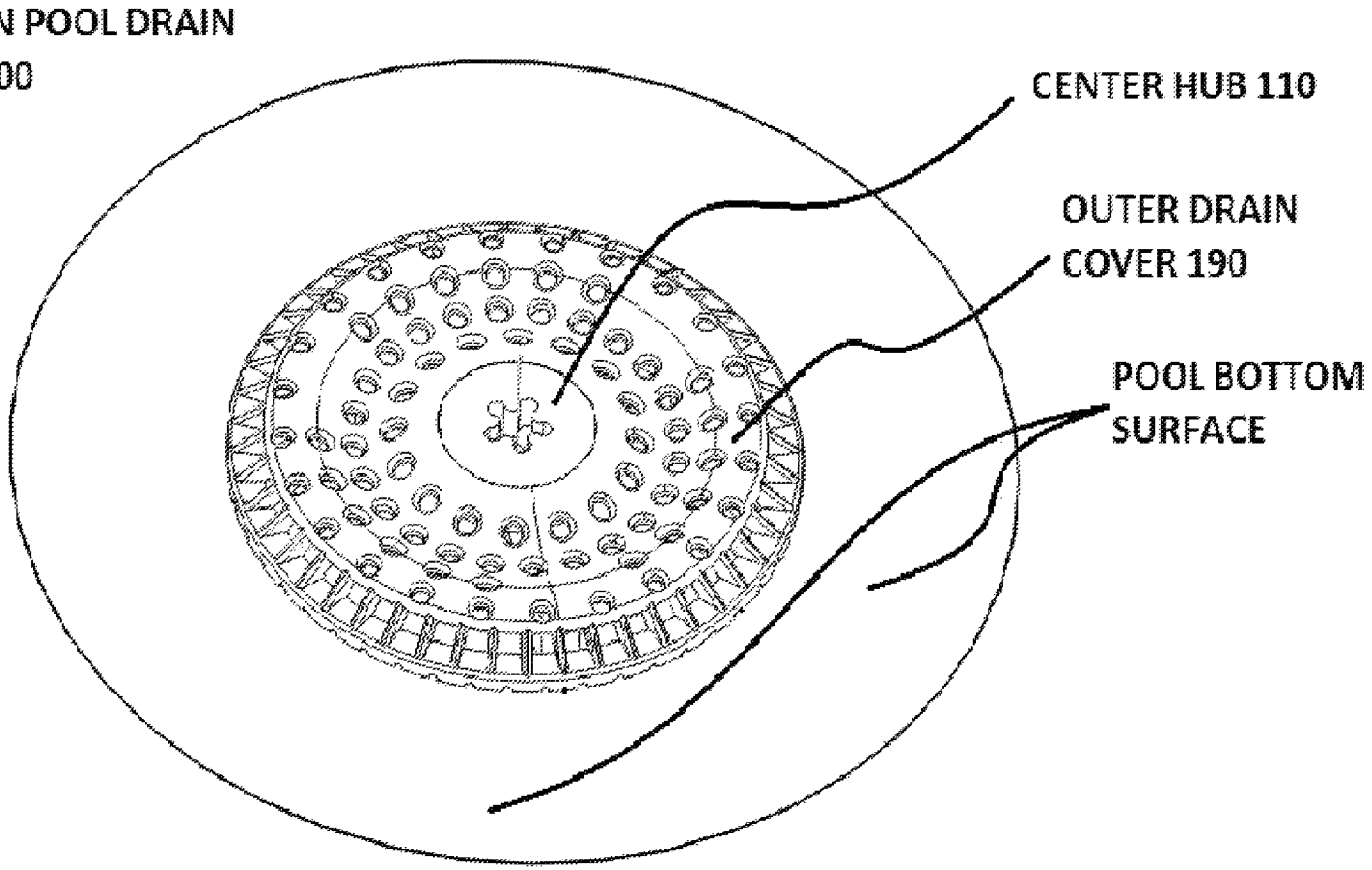
FIG. 1 is a top perspective view of a first example pool drain cover consistent with the present invention.
Figure 2:
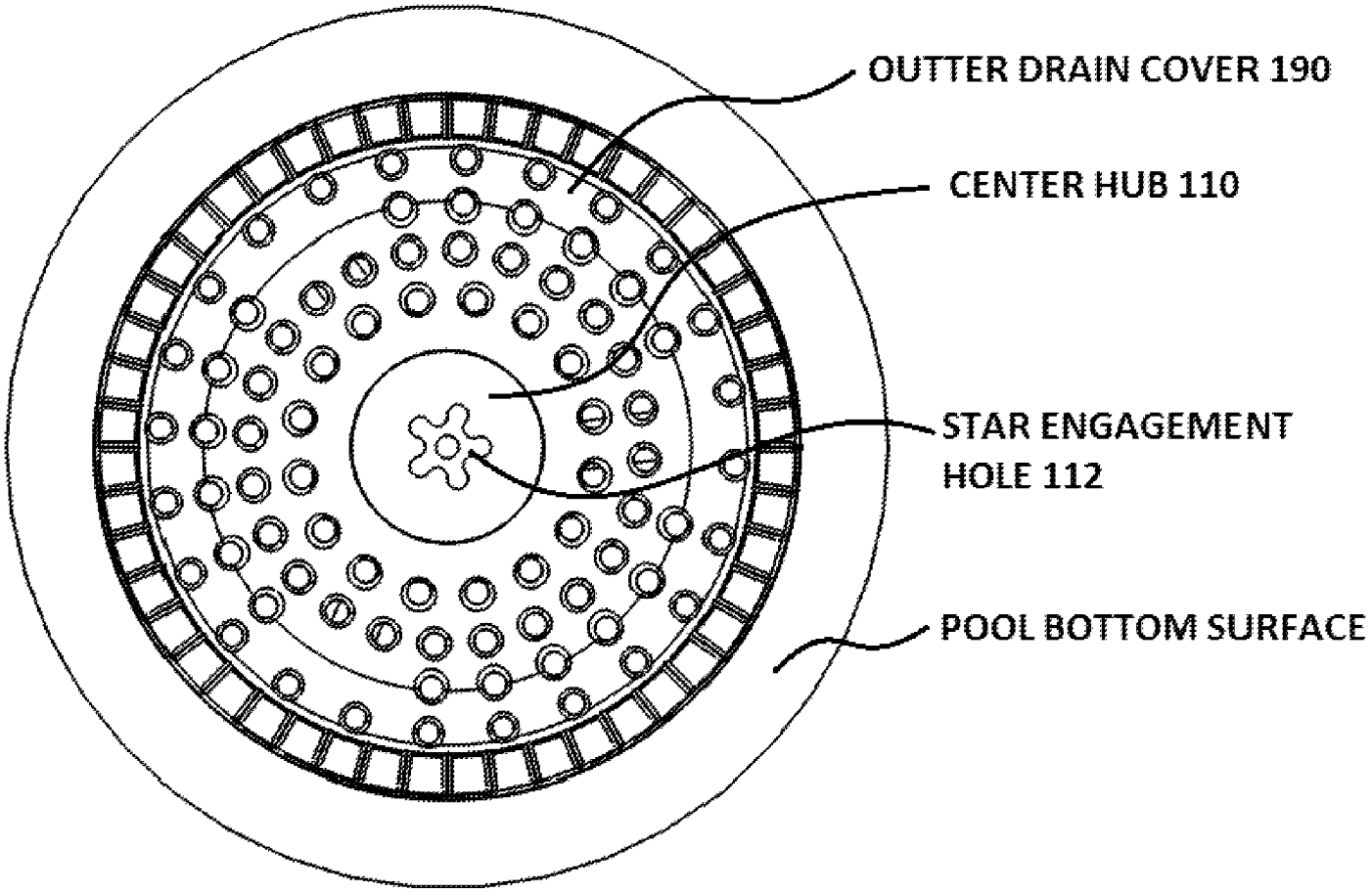
FIG. 2 is a top view of the first example pool drain cover consistent with the present invention.

FIG. 1 is a top perspective view, and FIG. 2 is a top view, of a first example pool drain cover 100 consistent with the present invention. The first example pool drain cover 100 is a circular device including a center hub 110 that can rotate with respect to an outer drain cover 190. The center hub 110 may be held in place (axially) by a lip on its bottom which locks it in place as an assembly with the outer drain cover 190. The center hub 110 may be twisted by hand, or by either a half inch wrench or a tool that fits into a star pattern engagement hole 112 in its center. The star pattern engagement hole 112 exists to facilitate receiving the tool by making it unnecessary to have the tool in a precise perpendicular placement with respect to the engagement hole 112. Naturally, other means for allowing the center hub 110 to be twisted with respect to the outer drain cover 190 (by hand, or with a tool such as Allen-wrench slots, square drive slots, etc.), one of which is described in detail below with respect to FIGS. 8, 9 and 16, may be provided instead of the star pattern engagement hole 112.

Figure 3:
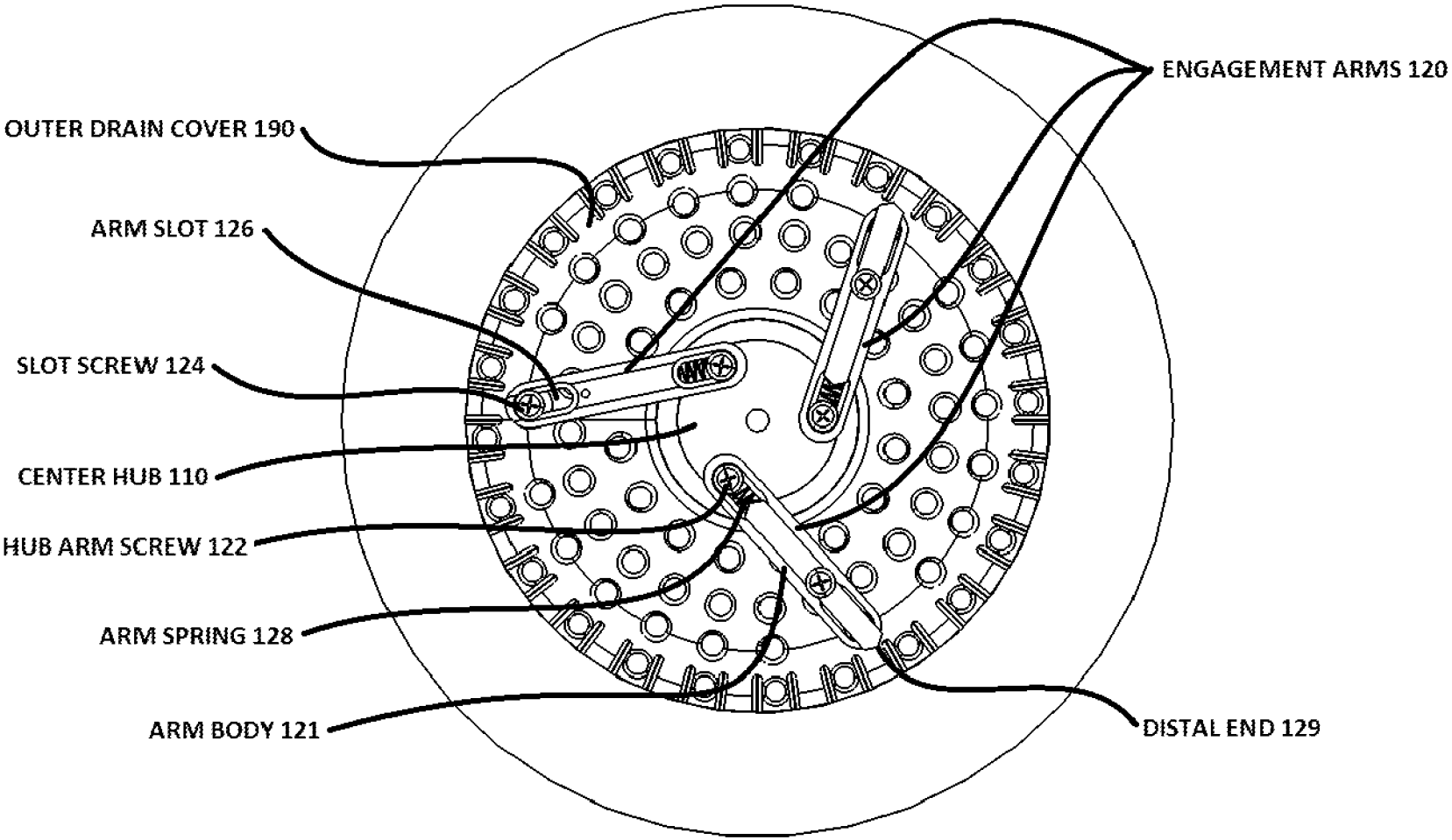
FIG. 3 is a bottom view of the first example pool drain cover consistent with the present invention, in a first state in which engagement arm assemblies are not extended.
Figure 4:
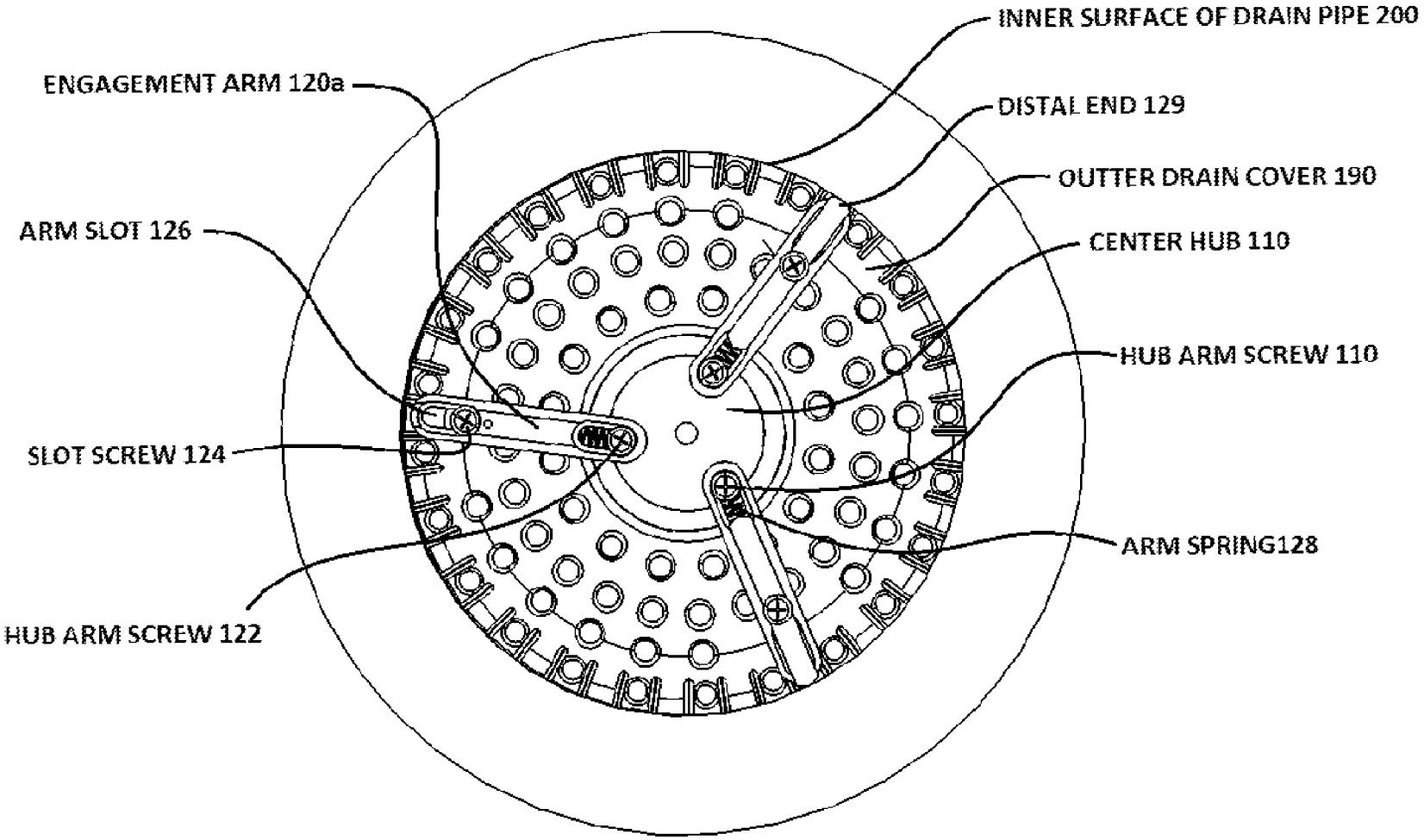
FIG. 4 is a bottom view of the first example pool drain cover consistent with the present invention, in a second state in which engagement arm assemblies are extended to engage with an inner surface of a pool drain pipe.

FIG. 3 is a bottom view of the first example pool drain cover consistent with the present invention, in a first state in which engagement arm assemblies 120 are not extended, while FIG. 4 is a bottom view of the first example pool drain cover consistent with the present invention, in a second state in which engagement arm assemblies 120 are extended to engage with an inner surface of a pool drain pipe. As shown, each of the engagement arm assemblies 120 includes an arm body 121, a hub arm screw 122, a slot screw 124, an arm slot 126 and an arm spring 128. A distal end 129 of each of the engagement arm assemblies 120 may be provided with a non-slip coating. As shown, each of the engagement arm assemblies 120 has a hub arm screw 122 which rotateably holds the arm body 121 to the underside of the center hub 110. Each of the engagement arm assemblies 120 also has a slot screw 124 which rotateably and slidingly holds the arm body 121 to the underside of the outer drain cover 190. The screws 122, 124 may be stainless steel screws, and may be threaded through bushings to both the outer drain cover 190 and the center hub 110. Finally, the center hub 110 includes a rotation limit stop surface 130 which limits the rotation of the center hub 110 with respect to the outer drain cover.

Figure 5:
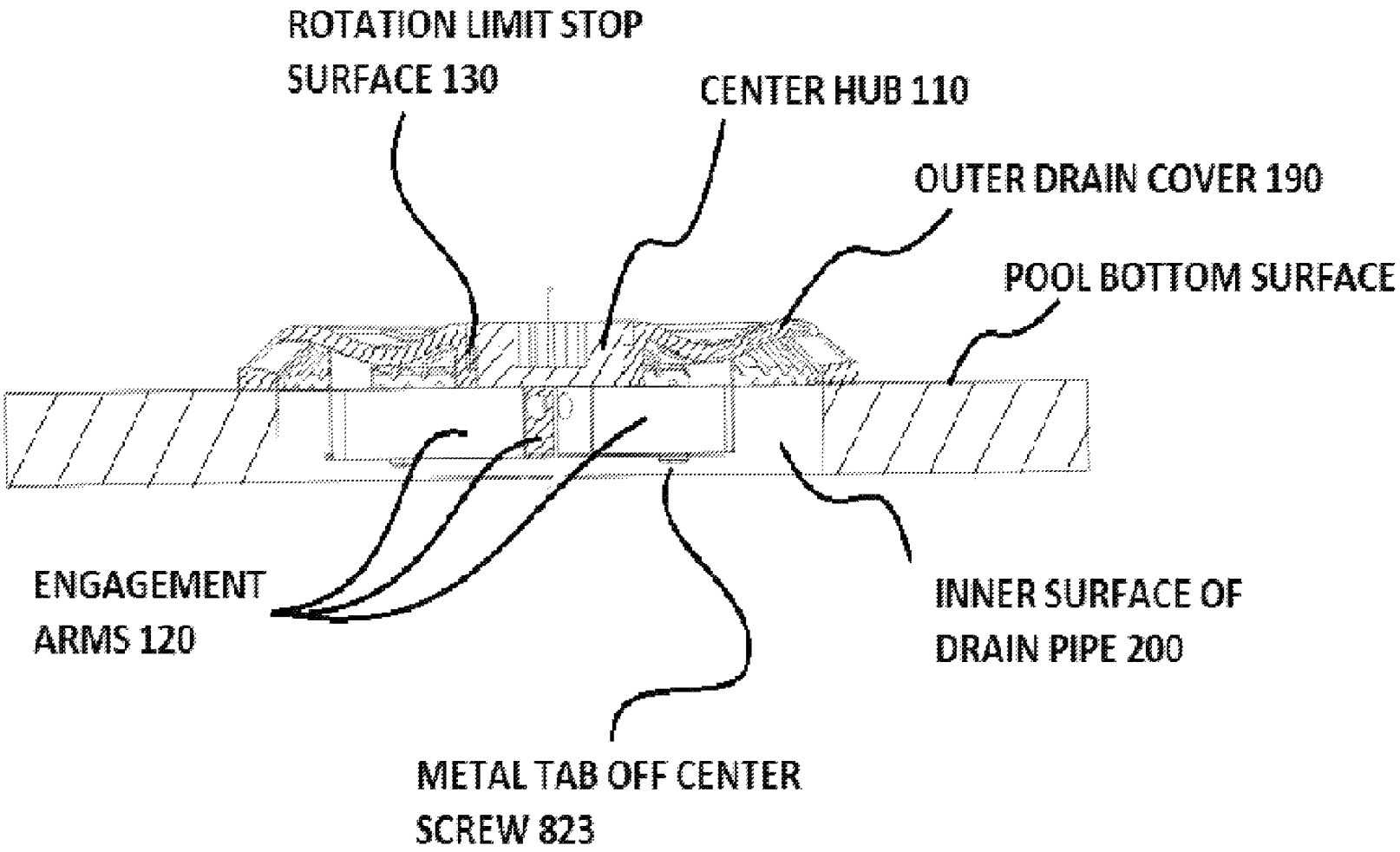
FIG. 5 is a partial cut away side view of the first example pool drain cover consistent with the present invention.

As shown in FIG. 4, outward tension is created by the compressed arm springs 128 inside the arm bodies 121. That is, when the center hub 110 is twisted, the arm springs 128 are compressed, thereby exerting an outward force on the engagement arm bodies 121, causing their distal ends 129 (preferably provided with an anti slip substance, or an anti slip finish) to press against the inside surface 200 of the drain pipe. This anti-slip substance could be vinyl, rubber, or some other anti-slip substance. As another example, the distal ends 129 can be roughened to increase their coefficient of friction. The example cover 100 can fit multiple size drains because the engagement arms 120 will conform to the different diameters of the drains. Note that further clockwise (as viewed from the bottom) rotation of the center hub 110 with respect to the outer drain cover 190 is prevented because the rotation limit stop surface 130 abuts a rotation limit screw 132. Naturally, other means of limiting the rotation of the center hub 110 with respect to the outer drain cover 190 may be used instead. FIG. 5 is a partial cut away side view of an example pool drain cover consistent with the present invention.

Figure 6:
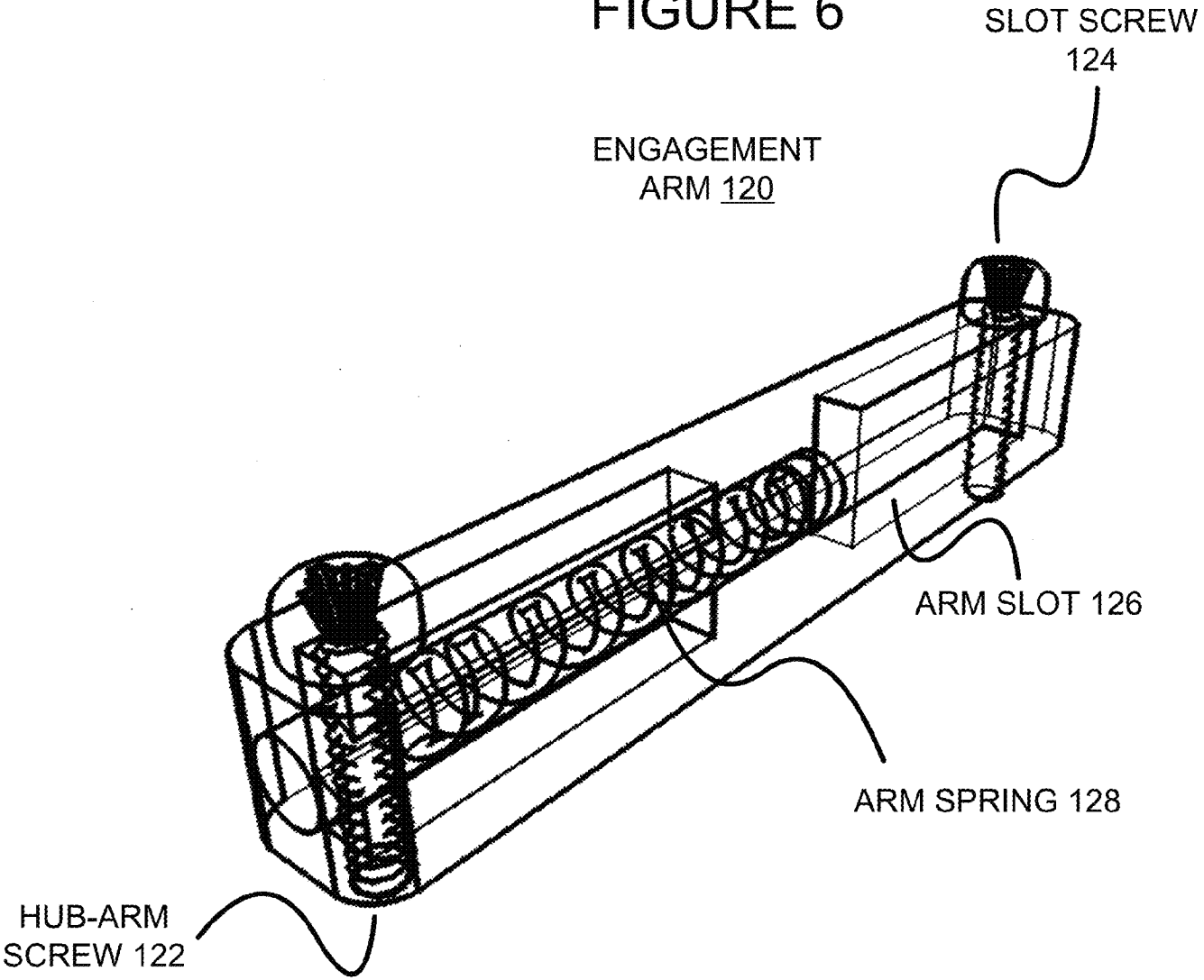
FIG. 6 is a wireframe perspective view of an example engagement arm assembly that may be used in the first example pool drain cover.
Figure 7:
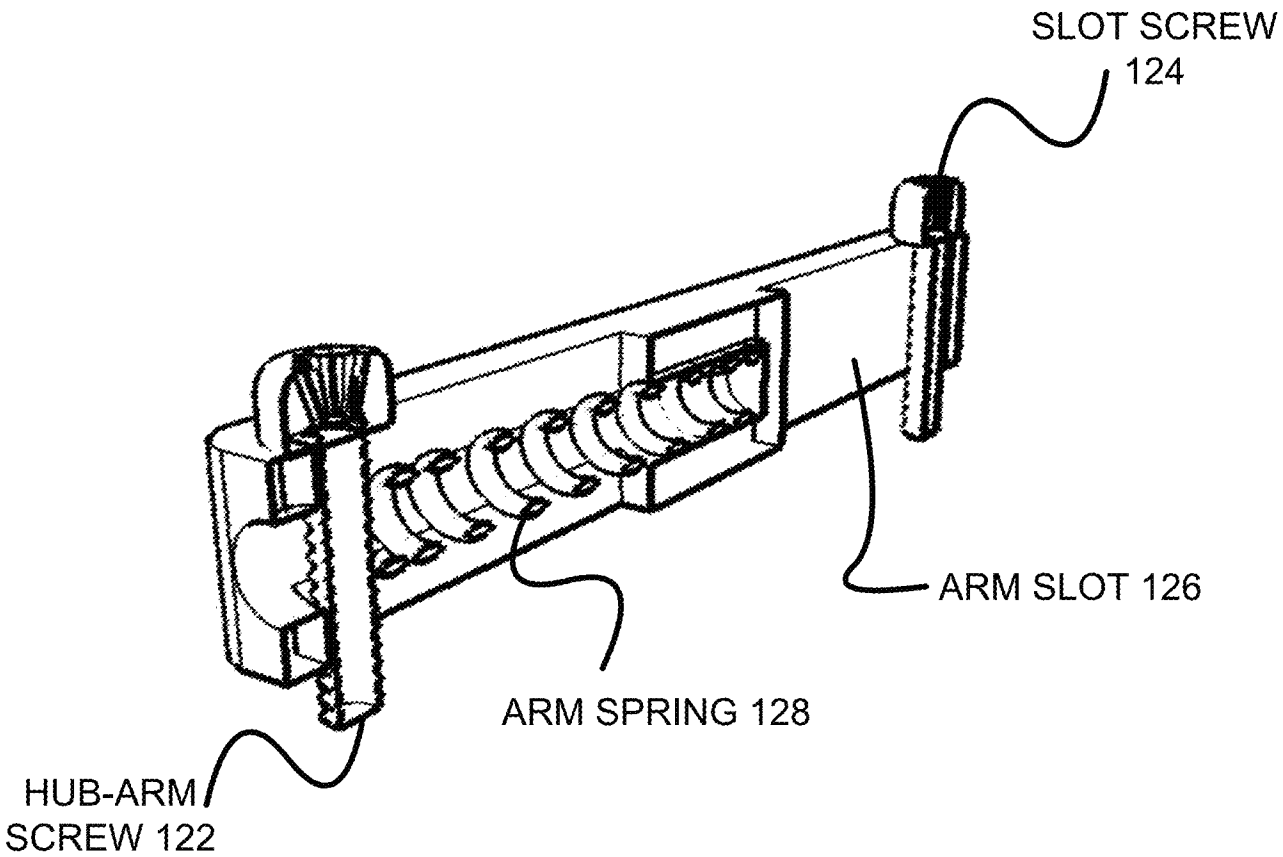
FIG. 7 is a cross-section of a perspective view of an example engagement arm assembly that may be used in the first example pool drain cover.

FIG. 6 is a wireframe perspective view of an example engagement arm assembly 120 that may be used in the first example pool drain cover, while FIG. 7 is a cross-section of a perspective view of a first example engagement arm assembly 120 that may be used in the first example pool drain cover. In at least some embodiments consistent with the present invention, the engagement arm bodies 121 are made from the same material as the drain cover (e.g., PVC with U.V. inhibitors, or other pool environment resistant materials such as, for example, glass reinforced plastic ("GRFP"), high-density polyethylene ("HDPE"), resin based composites, etc.). In at least some embodiments consistent with the present invention, the arm springs 128 may be a stainless alloy compression style spring with closed ends. Characteristics of the arm springs 128 such as coil diameter, pitch, length, height, etc.

may depend, at least in part, on drain cover size and Consumer Product Safety Commission (CPSC) and/or Underwriters Laboratories (UL) requirements. In one example embodiment intended to cover an 8" drain pipe, closed end 0.25" diameter compression springs may be used. In operation, the arm springs 128 may be under some tension or compression. The arm springs 128 may be held in place by a hole drilled into the arm body 121. A hole may be drilled on the spring side of the arm body 121 that is larger than the width of the slot 126 in the arm body 121. The spring 128 used in the engagement arm assembly 120 may have a larger diameter than the slot 126. The edges of the hole drilled in the arm body 121 may prevent the spring 128 from popping out. This drilled hole also makes it easy to install the spring and also allows the arm body 121 to be made with a less complex mold.

Figure 8:
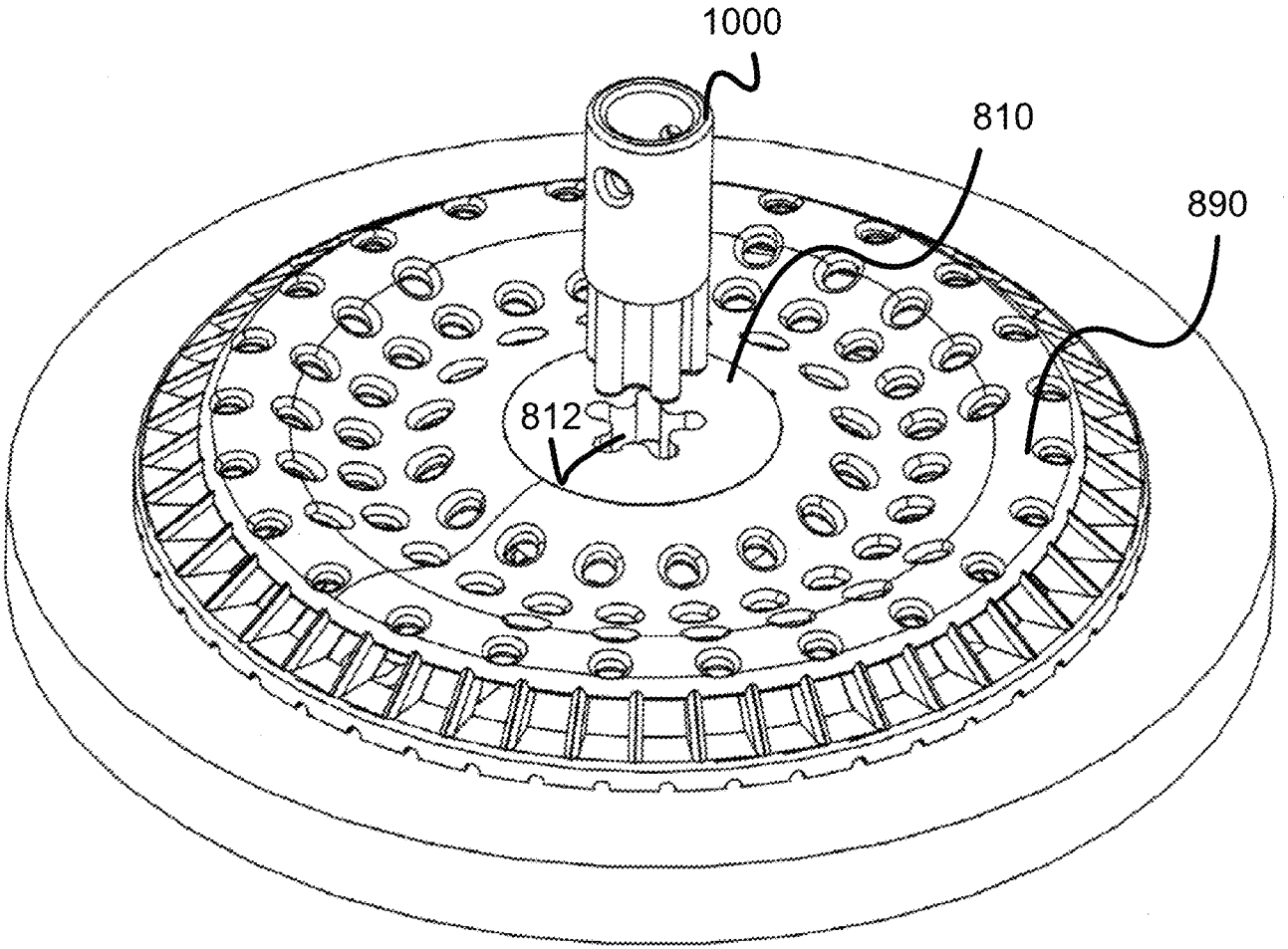
FIG. 8 is a top perspective view of a second example pool drain cover, along with a universal hub adaptor.
Figure 9:
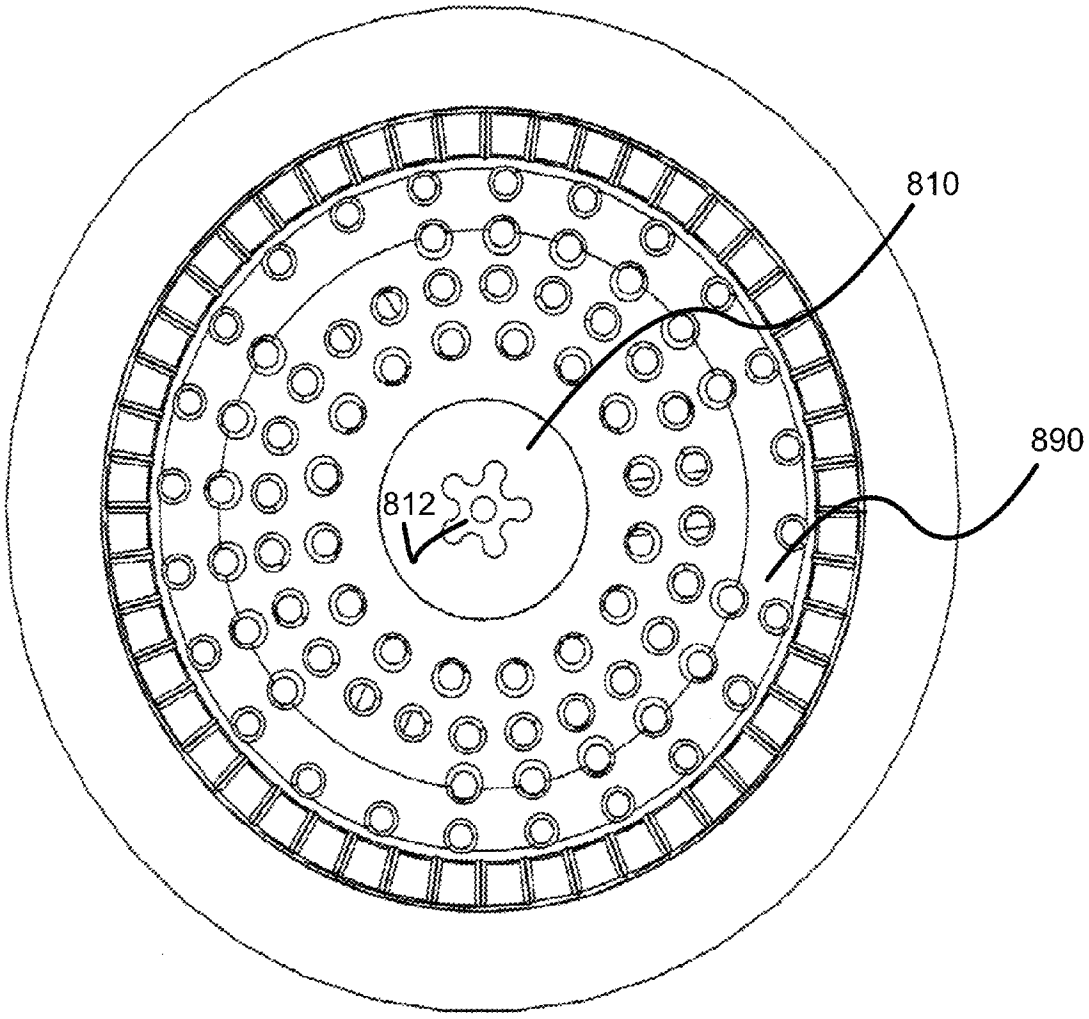
FIG. 9 is a top view of the second example pool drain cover.
Figure 16:
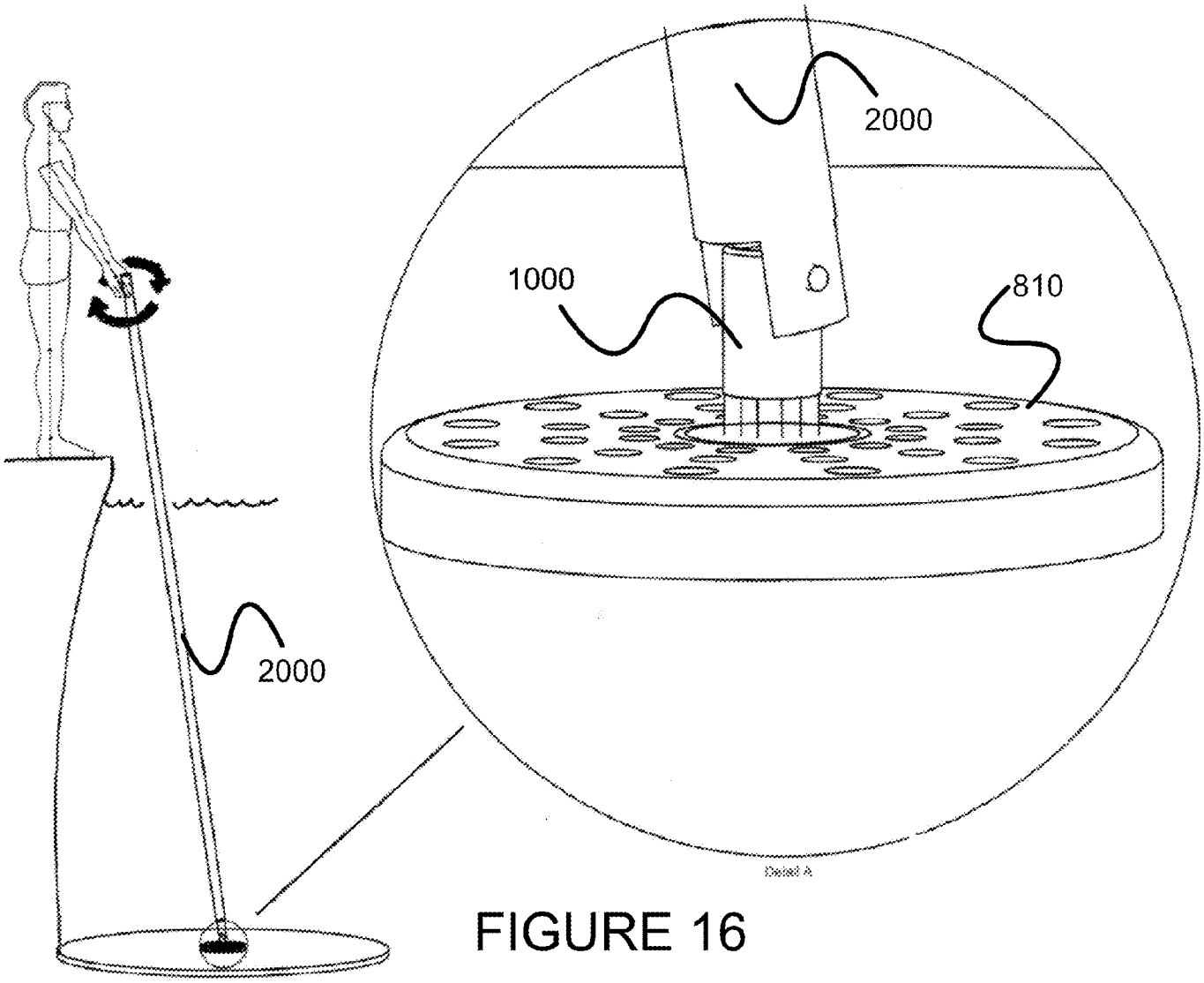
FIG. 16 illustrates how a universal hub, together with a standard pool rod, can be used to install and remove an example pool drain cover consistent with the present invention.

FIG. 8 is a top perspective view, and FIG. 9 is a top view, of a second example pool drain cover 800 consistent with the present invention. The second example pool drain cover 800 is also a circular device including a center hub 810 that can rotate with respect to an outer drain cover 890. The center hub 810 may be held in place (axially) by a lip on its bottom which locks it in place as an assembly with the outer drain cover 890. The center hub 810 may be twisted by hand, or by either a half inch wrench or a tool that fits into a rounded star pattern engagement hole 812 in its center. In this case, a universal hub adapter 1000, which can be provided at the end of standard pool rod, includes extensions that engage with the recesses of the rounded star pattern engagement hole 812. The rounded star pattern engagement hole 812 exists to facilitate receiving the tool by making it unnecessary to have the tool in a precise perpendicular placement with respect to the engagement hole 812. Naturally, other means for allowing the center hub 810 to be twisted with respect to the outer drain cover 890 (by hand, or with a tool such as Allen-wrench slots, square drive slots, etc.), may be provided instead. It is easier to slip the universal hub adaptor 1000 into this larger, smoother engagement hole 812 than it would be for a similar hub adaptor to be slipped into the star shaped engagement hole 112. This permits a person to install or remove the pool drain cover from outside the pool as depicted in FIG. 16.

In the second example pool drain cover 800, the vent holes in the outer drain cover 890 are round (or rounded) as compared with the substantially rectangular vent holes in the outer drain cover 190 of the first example pool drain cover 100. In one example embodiment consistent with the present invention, the holes are no larger than 5/16" in diameter. This prevents most jewelry from getting sucked in and stuck. Also, the top of the second example pool drain cover 800 is somewhat concave. This shape can help prevent a large flat body from completely blocking the cover.

Figure 10:
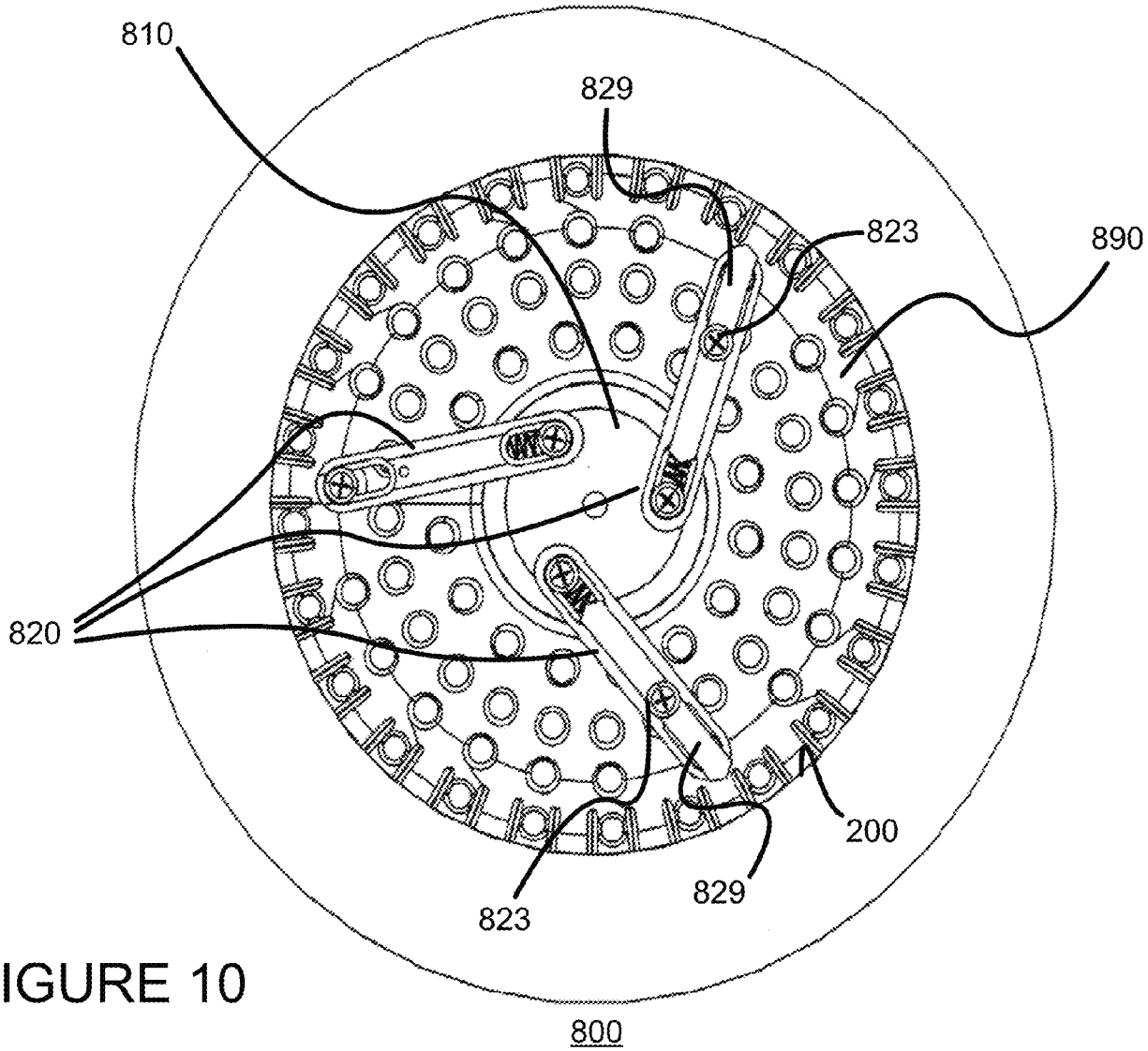
FIG. 10 is a bottom view of the second example pool drain cover consistent with the present invention, in a first state in which engagement arm assemblies are not extended.
Figure 11:
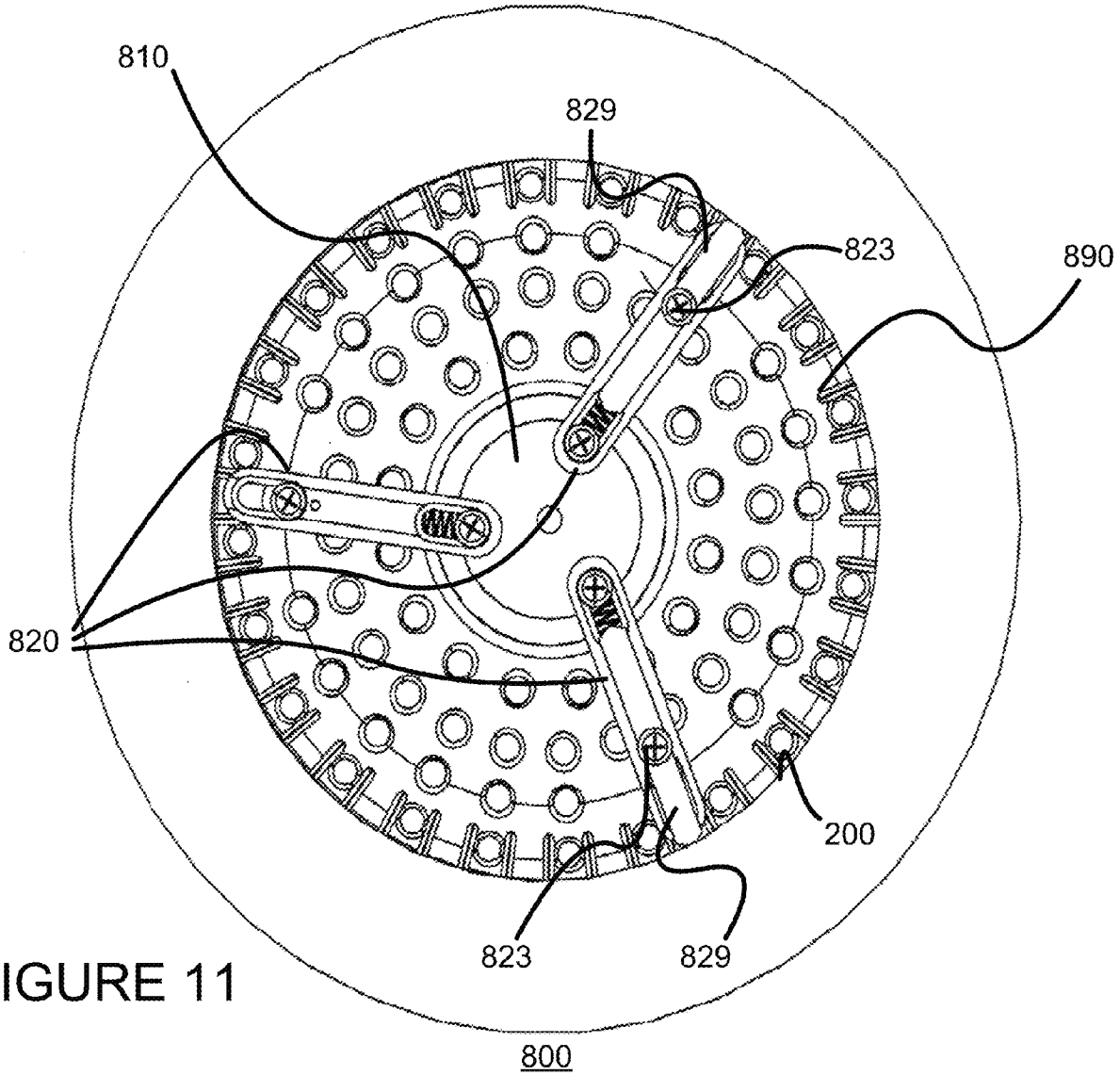
FIG. 11 is a bottom view of the second example pool drain cover consistent with the present invention, in a second state in which engagement arm assemblies are extended to engage with an inner surface of a pool drain pipe.
Figure 12:
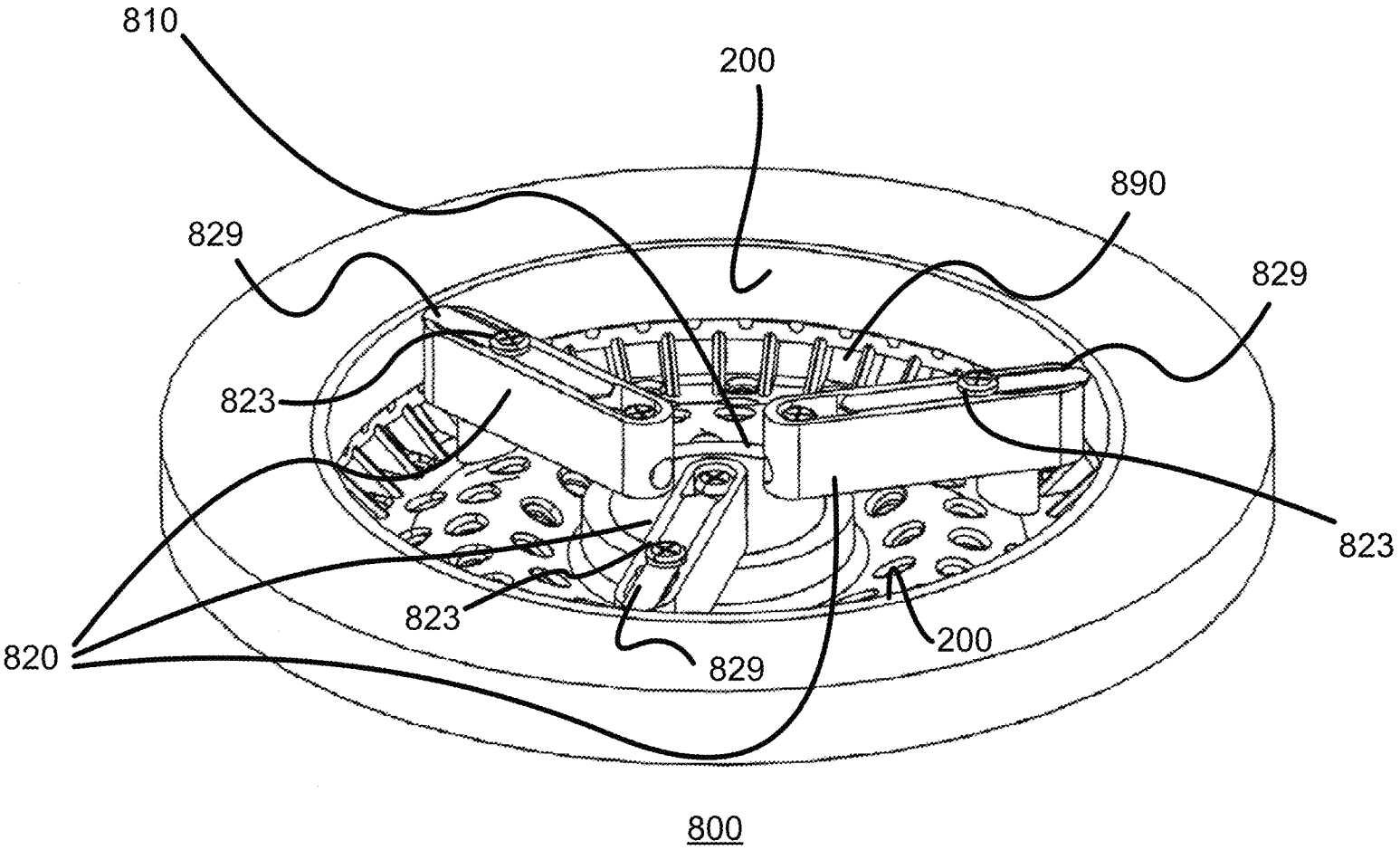
FIG. 12 is a bottom perspective view of the second example pool drain cover consistent with the present invention, in a second state in which engagement arm assemblies are extended to engage with an inner surface of a pool drain pipe.

FIG. 10 is a bottom view of the second example pool drain cover 800 consistent with the present invention, in a first state in which engagement arm assemblies 820 are not extended, while FIG. 11 is a bottom view of the second example pool drain cover 800 consistent with the present invention, in a second state in which engagement arm assemblies 820 are extended to engage with an inner surface of a pool drain pipe.

Referring to FIGS. 10-13, as was the case with the engagement arm assemblies 120 of the first embodiment, each of the engagement arm assemblies 820 includes an arm body 821, a hub arm screw 822, a slot screw 824, an arm slot 826 and an arm spring 828. In the second example embodiment, a metal (e.g., stainless steel) tab 829 extends from the distal end of each of the engagement arm assemblies 820. In one example embodiment, the metal tabs 829 are 16 gauge stainless steel, but other materials and or thicknesses may be used. The metal tabs 829 (only shown on two of the three arms in FIGS. 10 and 11, are pointed to help hold the pool drain cover 800 in the pool drain. In the example embodiment shown, each of the metal tabs 829 has two pointed ends and is attached to the arm body by an off-center screw 823. If the shorter sides of the metal tabs 829 do not adequately hold the pool drain cover 800 to the pool drain, one or more of the metal tabs 829 can be rotated 180 degrees so that their longer sides (e.g., 0.25 inches longer than the shorter side) extend further, thereby providing a tighter grip. As was the case with the first example embodiment 100, in the second example embodiment 800, each of the engagement arm assemblies 820 has a hub arm screw 822 which rotateably holds the arm body 821 to the underside of the center hub 810. Each of the engagement arm assemblies 820 also has a slot screw 824 which rotateably and slidingly holds the arm body 821 to the underside of the outer drain cover 890. The screws 822-824 may be stainless steel screws, and may be threaded through bushings to both the outer drain cover 190, the arm body 821, and the center hub 110.

Figure 15:
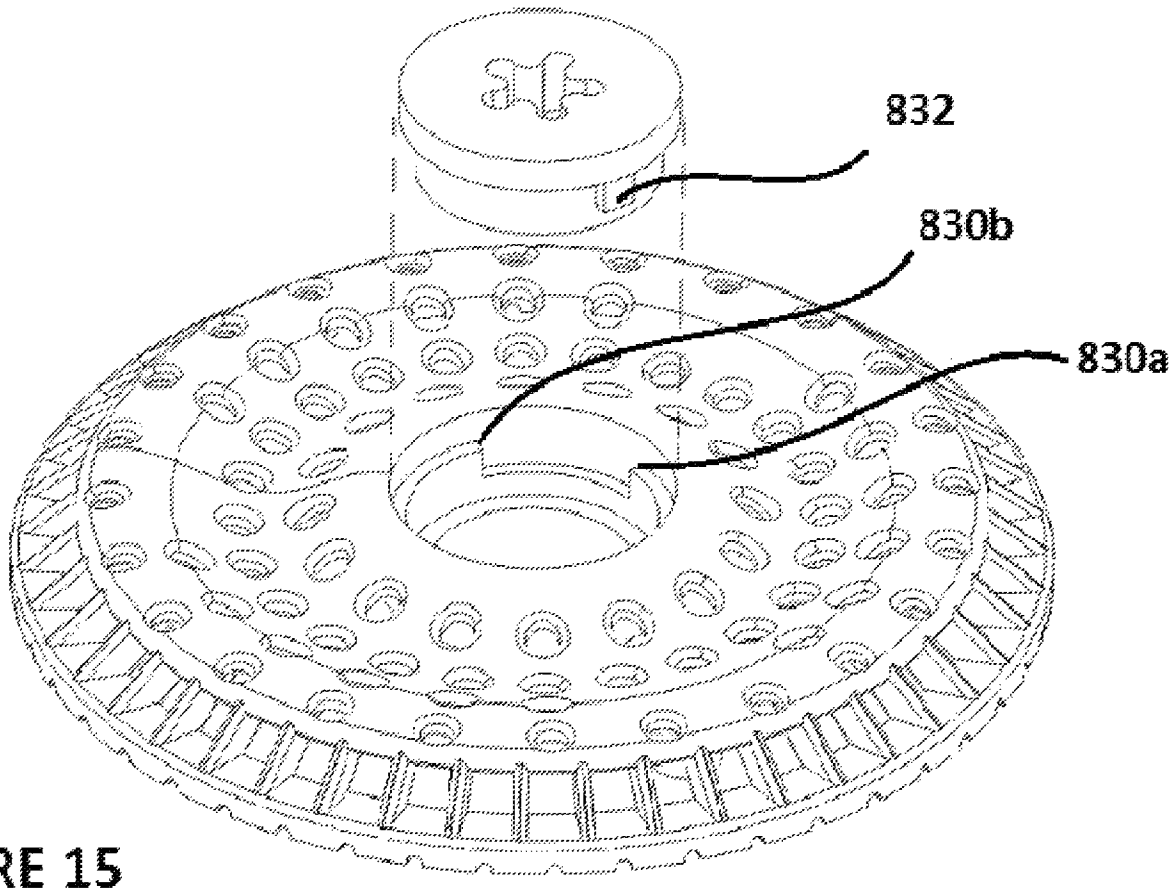
FIG. 15 is a transparent, top perspective, exploded view of a center hub and an outer pool drain cover illustrating rotation limit stops and a rotation limit tab.

As shown in FIG. 11, outward tension is created by the compressed arm springs 828 inside the arm bodies 821. That is, when the center hub 810 is twisted, the arm springs 828 are compressed, thereby exerting an outward force on the engagement arm bodies 821, causing the metal tabs 829 at their distal ends to press against the inside surface 200 of the drain pipe. The example cover 800 can fit multiple size drains because the engagement arms 820 will conform to the different diameters of the drains. Referring to FIG. 15, note that further clockwise (as viewed from the top rotation of the center hub 810 with respect to the outer drain cover 890 is prevented because the rotation limit stop surface **830*a* on the outer drain body 890 abuts a rotation limit tab 832 provided on the center hub 810. Counter-clockwise rotation can be similarly limited by the rotation limit stop surface 830*b*. Naturally, other means of limiting the rotation of the center hub 810 with respect to the outer drain cover 890** may be used instead.

Figure 13:
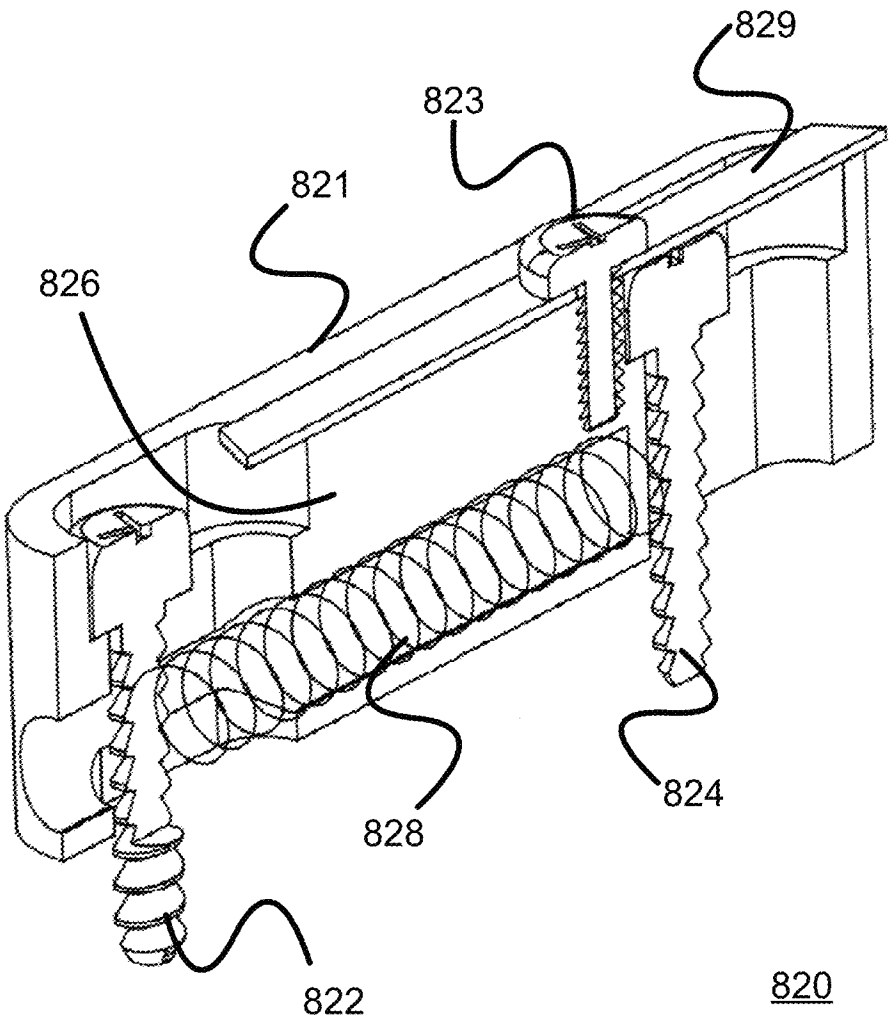
FIG. 13 is a cross-section of a perspective view of a modified engagement arm assembly that may be used in various example pool drain covers consistent with the present invention.
Figure 14:
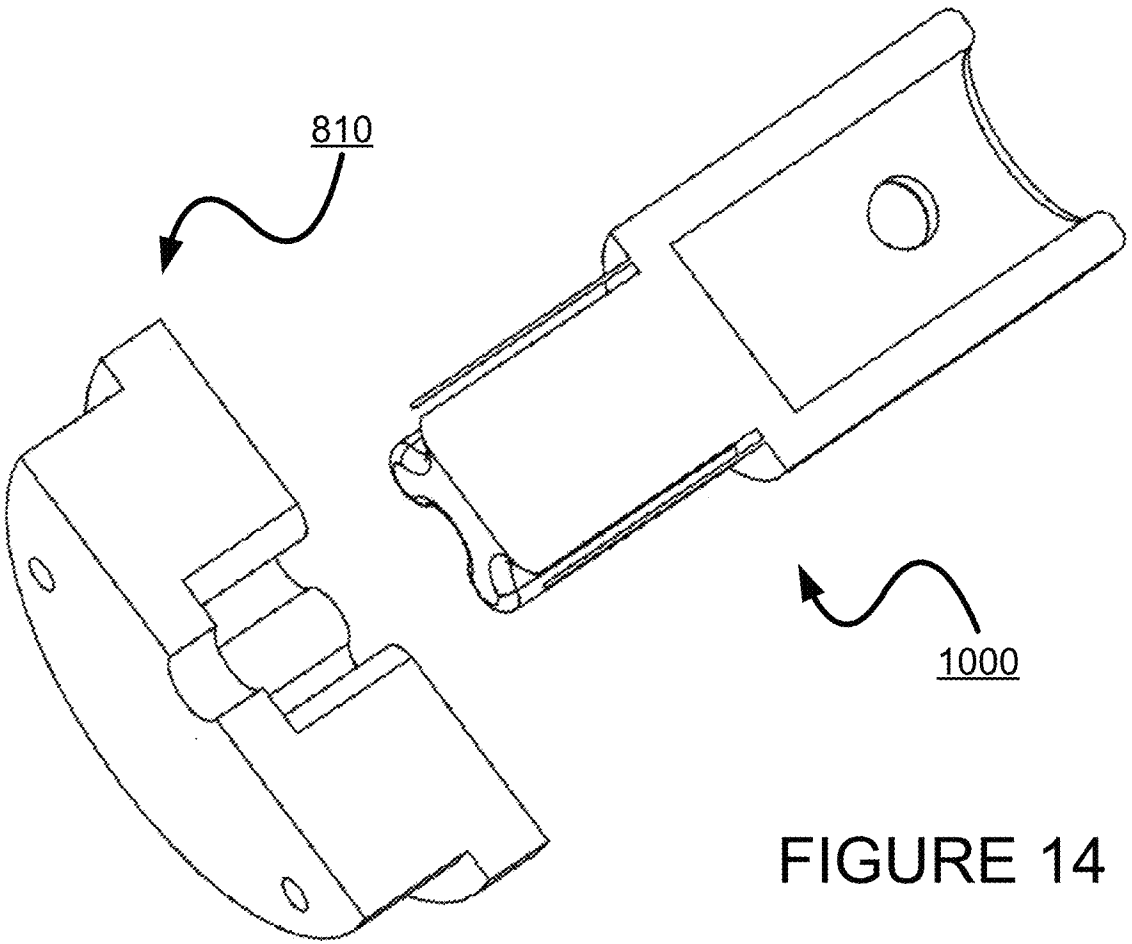
FIG. 14 is a cross-section of a perspective view of a universal hub adaptor and a center hub consistent with the present invention.

FIG. 13 is a cross-section of a perspective view of the second example engagement arm assembly 820 that may be used in the second example pool drain cover 800. In at least some embodiments consistent with the present invention, the engagement arm bodies 821 are made from the same material as the drain cover (e.g., PVC with U.V. inhibitors, or other pool environment resistant materials such as, for example, glass reinforced plastic ("GRFP"), high-density polyethylene ("HDPE"), resin based composites, etc.). In at least some embodiments consistent with the present invention, the arm springs 828 may be a stainless alloy compression style spring with closed ends. As discussed above with respect to the first example embodiment, characteristics of the arm springs 828 such as coil diameter, pitch, length, height, etc. may depend, at least in part, on drain cover size and CPSC/UL requirements. In operation, the arm springs 828 may be under some tension or compression. The arm springs 828 may be held in place by a hole drilled into the arm body 821. A hole may be drilled on the spring side of the arm body 821 that is larger than the width of the slot 826 in the arm body 821. The spring 828 used in the engagement arm assembly 820 may have a larger diameter than the slot 826. The edges of the hole drilled in the arm body 821 may prevent the spring 828 from popping out. This drilled hole also makes it easy to install the spring and also allows the arm body 821 to be made with a less complex mold. Comparing FIGS. 13 and 7, notice that the slots 826 in the second example engagement arm assembly 820 may be shorter than those 126 in the first 120.

In at least some example embodiments consistent with the present invention, the drain cover may be made from PVC with U.V. inhibitors, or other pool environment resistant materials such as, for example, glass reinforced plastic ("GRFP"), high-density polyethylene ("HDPE"), resin based composites, etc. Corrosion resistant metals such as aluminum, brass, etc., may be used instead.

It should be understood that the present invention is not limited to the specific implementations described with respect to the first and second embodiments. Indeed, one or more components of the first embodiment might be replaced, or supplemented, with one or more components of the second embodiment, or vice-versa. For example, with appropriate adjustments that will be apparent to those skilled in the art, the center hub 810 of the second embodiment 800 might replace the center hub 110 of the first embodiment 100, or the engagement arms 120 of the first embodiment 100 might replace the engagement arms 820 of the second embodiment 800, or the engagement arms 120 of the first embodiment might be provided with the metal tabs 829 of the second embodiment, etc. Further modifications to the described embodiments will be apparent to those skilled in the art. For example, although not shown, instead of providing an engagement hole 112/812, the center hub 110/810 can be provided with an extension (such as a lever) being graspable by hand or with a tool, to permit the center hub 110/810 to be rotated with respect to the outer drain cover 190/890.

What is claimed is:

1. Apparatus for covering a drain having a circular inner diameter, the apparatus comprising:

a) an outer drain cover having
  a central opening,
  a top side surface facing away from the drain, and
  a bottom side surface facing the drain;

b) a center hub
  rotateably accommodated in the central opening of the outer drain cover,
  having a top side surface facing away from the drain, and
  having a bottom side surface facing the drain; and c) a plurality of engagement arm assemblies, each being
  rotateably coupled with the bottom side surface of the center hub, and
  slideably coupled with the bottom side surface of the outer drain cover, wherein each of the plurality of engagement arm assemblies includes an arm body and a metal tab extending beyond a distal end of the arm body, and wherein each of the metal tabs is thin and flat.

2. The apparatus of claim 1 having a first state and a second state, wherein a distal end of each of the engagement arm assemblies extends further from the center hub in the second state than in the first state.

3. The apparatus of claim 2 wherein each of the engagement arm assemblies includes a biasing component which exerts a radially outward directed force on the slideable coupling with the bottom side surface of the outer drain cover when the apparatus is in the second state.

4. The apparatus of claim 3 wherein each of the biasing components is a helical spring.

5. The apparatus of claim 1 wherein each of the plurality of engagement arm assemblies includes a slot, a hole having an axis substantially parallel with the slot, and a spring provided within the hole, wherein each of the plurality of engagement arm assemblies is slideably coupled with the bottom side surface of the outer drain cover with a component, the component being fixed to the bottom side surface of the outer drain cover and slideable within the slot, and wherein each of the springs biases the respective engagement arm away from the center hub.

6. The apparatus of claim 5 wherein a diameter of each of the holes is greater than a width of the corresponding slot.

7. The apparatus of claim 5 wherein each of the holes is provided on a side of the corresponding engagement arm adjacent to the center hub.

8. The apparatus of claim 1 wherein each of the plurality of engagement arm assemblies includes an arm body and a two-sided metal tab removably connected, off-center, with the arm body such that one of the sides of the metal tab extends beyond a distal end of the arm body.

9. The apparatus of claim 1 wherein the outer drain cover is made from a material selected from a group consisting of (A) PVC with ultraviolet ray (U.V.) inhibitors, (B) glass reinforced plastic ("GRFP"), (C) high-density polyethylene ("HDPE"), and (D) resin based composites.

10. The apparatus of claim 1 wherein the center hub is made from a material selected from a group consisting of (A) PVC with U.V. inhibitors, (B) glass reinforced plastic ("GRFP"), (C) high-density polyethylene ("HDPE"), and (D) resin based composites.

11. The apparatus of claim 1 wherein each of the plurality of engagement arm assemblies includes an arm body made from a material selected from a group consisting of (A) PVC with U.V. inhibitors, (B) glass reinforced plastic ("GRFP"), (C) high-density polyethylene ("HDPE"), and (D) resin based composites.

12. The apparatus of claim 1 wherein both the outer drain cover and the center hub are provided with components to limit the degree of rotation of the center hub with respect to the outer drain cover.

13. The apparatus of claim 1 wherein the center hub includes an engagement hole for receiving a torque providing tool.

14. The apparatus of claim 13 wherein the engagement hole has a profile including vertices.

15. The apparatus of claim 14 wherein the engagement hole has a pointed star profile.

16. The apparatus of claim 13 wherein the engagement hole has a profile with rounded edges.

17. The apparatus of claim 16 wherein the profile of the engagement hole has no vertices.

18. The apparatus of claim 1 wherein the top side surface of the outer drain cover has a concave cross-sectional profile.

* * * * *